US008328189B2

(12) United States Patent
Okamura

(10) Patent No.: US 8,328,189 B2
(45) Date of Patent: Dec. 11, 2012

(54) SHEET CONVEYING DEVICE AND IMAGE FORMING APPARATUS

(75) Inventor: Takuya Okamura, Ibaraki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 61 days.

(21) Appl. No.: 12/861,398

(22) Filed: Aug. 23, 2010

(65) Prior Publication Data

US 2011/0233856 A1 Sep. 29, 2011

(30) Foreign Application Priority Data

Mar. 24, 2010 (JP) ..... 2010-067915

(51) Int. Cl.
*B65H 7/02* (2006.01)

(52) U.S. Cl. ..... 271/258.05; 271/256; 271/258.01

(58) Field of Classification Search ..... 271/256, 271/258.01, 258.05
See application file for complete search history.

(56) References Cited

U.S. PATENT DOCUMENTS 5,042,790 A * 8/1991 Miller et al. ..... 271/110
5,377,805 A * 1/1995 Ono et al. ..... 194/206
5,964,460 A * 10/1999 Azumi et al. ..... 271/265.01
6,019,362 A * 2/2000 Yazawa ..... 271/4.01
6,259,867 B1 * 7/2001 Park et al. ..... 399/21
7,690,651 B2 * 4/2010 Kubochi ..... 271/265.01
2006/0255526 A1 * 11/2006 Ginzton ..... 271/121
2010/0052241 A1 * 3/2010 Sekiyama et al. ..... 271/4.01
2010/0061781 A1 * 3/2010 Won ..... 399/367

FOREIGN PATENT DOCUMENTS

JP 63277149 A * 11/1988
JP 01022736 A * 1/1989
JP 06171794 A * 6/1994
JP 2007-297141 A 11/2007
JP 2009-122404 A 6/2009
JP 2009-151027 A 7/2009

* cited by examiner

*Primary Examiner* — Prasad Gokhale
(74) *Attorney, Agent, or Firm* — Sughrue Mion, PLLC

(57) ABSTRACT

A sheet conveying device with a sheet conveyance path through which a sheet is conveyed include: a sheet guide that has a first end rotatably supported to move a second end to be close to or away from the sheet conveyance path; and a sheet detecting section that has a first end protruding beyond the sheet guide and a second end rotatably supported so that the first end is pushed by the sheet and rotated. A rotation shaft of the sheet detecting section is disposed farther from the sheet conveyance path than a rotation shaft of the sheet guide, and the sheet guide is provided with a moving portion for moving the first end of the sheet detecting section to an inside of a guide face of the sheet guide.

10 Claims, 5 Drawing Sheets

SHEET CONVEYING DEVICE AND IMAGE FORMING APPARATUS

CROSS-REFERENCE TO RELATED APPLICATION

This application is based on and claims priority under 35 USC 119 from Japanese Patent Application No. 2010-067915 filed on Mar. 24, 2010.

BACKGROUND

1. Technical Field

The present invention relates to a sheet conveying device and an image forming apparatus including the sheet conveying device.

2. Related Art

In an image forming apparatus, paper detecting means is provided everywhere in a paper conveyance path, so as to check presence of paper before performing a prescribed process on the paper. In employing paper detecting means for mechanically detecting paper by allowing paper to come into contact with a sensor such as a lever, it is necessary to be careful not to damage the sensor with paper in removing jammed paper from the paper conveyance path.

SUMMARY

According to an aspect of the invention, a sheet conveying device with a sheet conveyance path through which a sheet is conveyed include: a sheet guide that has a first end rotatably supported to move a second end to be close to or away from the sheet conveyance path; and a sheet detecting section that has a first end protruding beyond the sheet guide and a second end rotatably supported so that the first end is pushed by the sheet and rotated, wherein a rotation shaft of the sheet detecting section is disposed farther from the sheet conveyance path than a rotation shaft of the sheet guide, and the sheet guide is provided with a moving portion for moving the first end of the sheet detecting section to an inside of a guide face of the sheet guide when the first end of the sheet guide is rotated in a direction away from the sheet conveyance path.

BRIEF DESCRIPTION OF THE DRAWINGS

Exemplary embodiments of the invention will be described in detail based on the following figures, wherein.

DETAILED DESCRIPTION

Now, a preferred exemplary embodiment of the invention will be described with reference to the accompanying drawings.

(1) Basic Structure and Operation of Printer

First, the basic structure and the operation of a printer (i.e., an image forming apparatus) according to an exemplary embodiment will be described.

Figure 1:
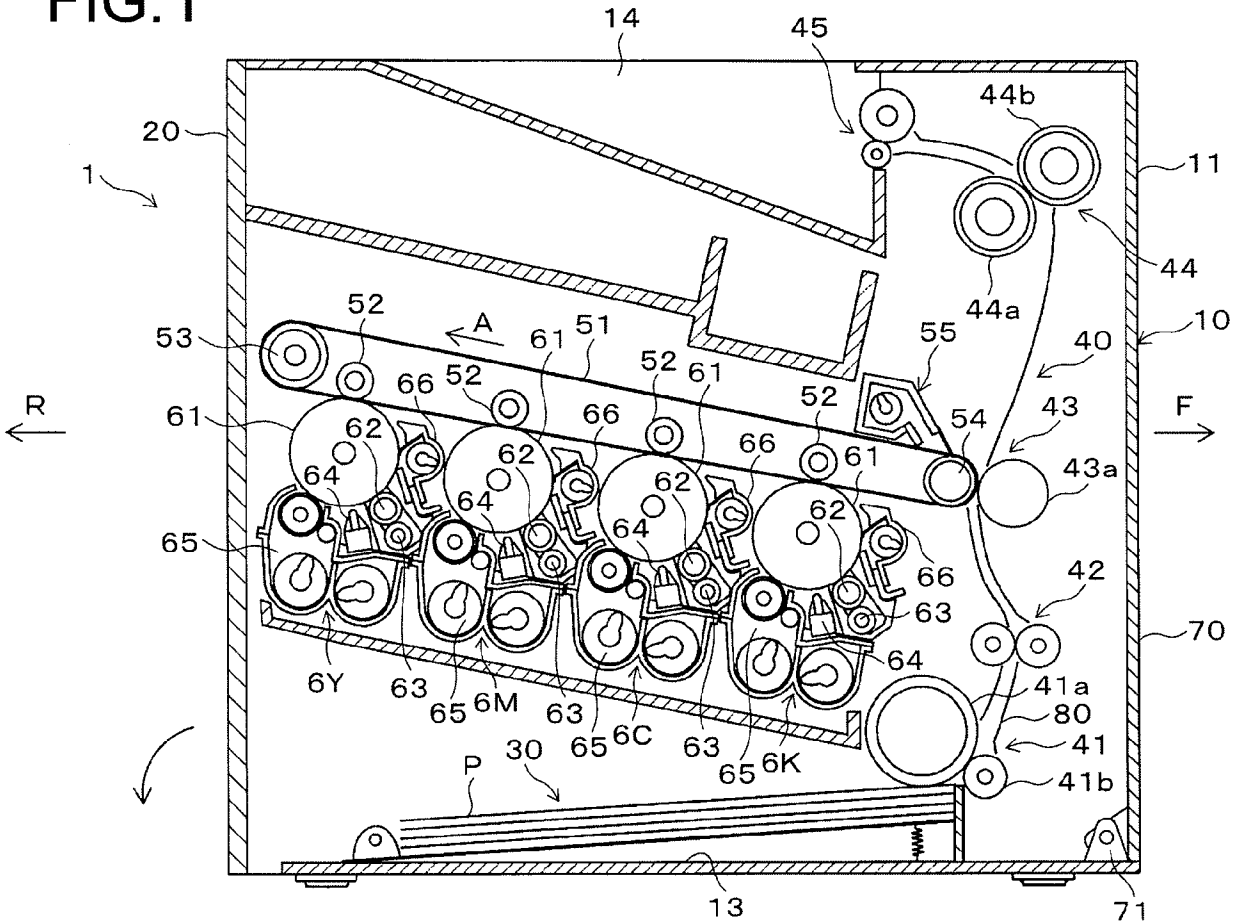
FIG. 1 is a side cross-sectional view of a printer according to an exemplary embodiment.

FIG. 1 illustrates the internal structure of a printer 1 according to the exemplary embodiment. In this drawing, a reference numeral 10 denotes an apparatus main body including a housing 11. The front face of the apparatus main body 10 is opened/closed by a front cover 70 described later. In the following description, a forward/backward or upper/lower direction corresponds to a direction within the apparatus main body 10 with an R direction of FIG. 1 regarded as the backward direction and an F direction regarded as the forward direction.

On the bottom of the apparatus main body 10, a paper tray 30 is provided. Paper (a sheet) P is drawn one by one in the forward direction by a paper drawing section 41, is elevated through a paper conveyance path 40 formed on a front side of the apparatus main body 10 and is fed to a paper output tray 14 formed on the top face of the apparatus main body 10.

The printer 1 is a tandem full-color printer, and a transfer belt 51 rotatably suspended to be inclined upward on the rear side (namely, on the left side in FIG. 1) and rotating in a direction of an arrow A, image formation units 6Y, 6M, 6C and 6K of four colors arranged in a row below the transfer belt 51, a secondary transferring section 43, a fixing section 44 and the like are provided in the apparatus main body 10. The image formation units (image forming sections) 6Y, 6M, 6C and 6K are arranged in parallel to the inclined direction of the transfer belt 51.

The four image formation units 6Y, 6M, 6C and 6K are used for forming toner images respectively of yellow (Y), magenta (M), cyan (C) and black (K), and have the same basic structure including a photosensitive drum 61, a charging roller 62 and a charging roller cleaner 63 disposed around the photosensitive drum 61, an image exposing device 64, a developing device 65 and a photosensitive drum cleaner 66.

Color image information is input to the printer 1 from a personal computer or the like, and when the color image information is input, four light beams respectively corresponding to the four colors are emitted from the image exposing device 64. Each of these light beams scans the surface of the photosensitive drum 61 rotating and charged by the charging roller 62. Thus, an electrostatic latent image of each corresponding color is formed on the surface of the photosensitive drum 61.

The electrostatic latent image formed on the photosensitive drum 61 is developed by the developing device 65 with a developer including a toner of each corresponding color, and the thus developed toner image (color image) is primarily transferred onto the surface (the outer circumferential face) of the rotating transfer belt 51 by a primary transfer roller 52. Such a primary transferring operation of development from the photosensitive drum 61 to the transfer belt 51 is performed successively in the image formation units 6Y, 6M, 6C and 6K at prescribed timing, and in passing the image formation unit 6K disposed on the most downstream side, a full-color toner image is formed on the surface of the transfer belt 51.

In some cases, residues such as a toner and a charge product may be adhered to the surface of the photosensitive drum 61 after the primary transfer, and the residues are removed by the photosensitive drum cleaner 66. The surface of the photosensitive drum 61 is charged again by the charging roller 62. It is noted that residues that cannot be sufficiently removed by the photosensitive drum cleaner 66 but are adhered to the charging roller 62 are removed by the charging roller cleaner 63 rotating in contact with the charging roller 62.

The transfer belt 51 is wound around a driving roller 53 and a backup roller 54 and is rotated in the direction of the arrow A by rotating the driving roller 53. The primary transfer rollers 52 are provided inside the transfer belt 51 so as to form nips together with the respective photosensitive drums 61 of the image formation units 6Y, 6M, 6C and 6K with the transfer belt 51 sandwiched therebetween.

The full-color toner image formed on the transfer belt 51 is transferred, in the secondary transferring section 43, onto paper P drawn from the paper tray 30 by the paper drawing section 41 to be elevated through the paper conveyance path 40 at appropriate timing. The paper drawing section 41 includes a feeding roller 41*a* and a paper separating roller 41*b*, so that the paper P is separated by the paper drawing section 41 one by one in the forward direction and is conveyed once to a resist roller pair 42 disposed above and is halted there. Then, the paper P is fed to the secondary transferring section 43 by the resist roller pair 42 rotatively driven at prescribed timing. Incidentally, a paper conveying device corresponding to the feature of this exemplary embodiment is provided below the resist roller pair 42. The detailed structure of the paper conveying device will be described later.

The secondary transferring section 43 includes the backup roller 54 suspending the transfer belt 51 and a secondary transfer roller 43*a* forming a nip with the backup roller 54, and the paper P passes between theses rollers 54 and 43*a*, so that the full-color toner image formed on the transfer belt 51 may be transferred onto the paper P. In some cases, residues such as a toner may be adhered to the surface of the transfer belt 51 after the secondary transfer, the residues are removed by a transfer belt cleaner 55 disposed above a front end of the transfer belt 51.

The paper P having the transferred full-color toner image thereon passes the fixing section 44, and the color toner image is fixed on the paper P in this fixing section 44. The fixing section 44 includes a heating roller 44*a* and a pressure roller 44*b* forming a nip with the heating roller 44*a*, and the full-color toner image is fixed on the paper P through the functions of both pressure and heating by allowing the paper P to pass between the rollers 44*a* and 44*b*. Then, the paper P having passed the fixing section 44 is fed by a paper output roller pair 45 to the paper output tray 14. The paper conveyance path 40 includes a path extending from the paper drawing section 41 through the resist roller pair 42, the secondary transferring section 43 and the fixing section 44 to the paper output roller pair 45.

(2) Structure of Paper Conveying Device

Figure 2:
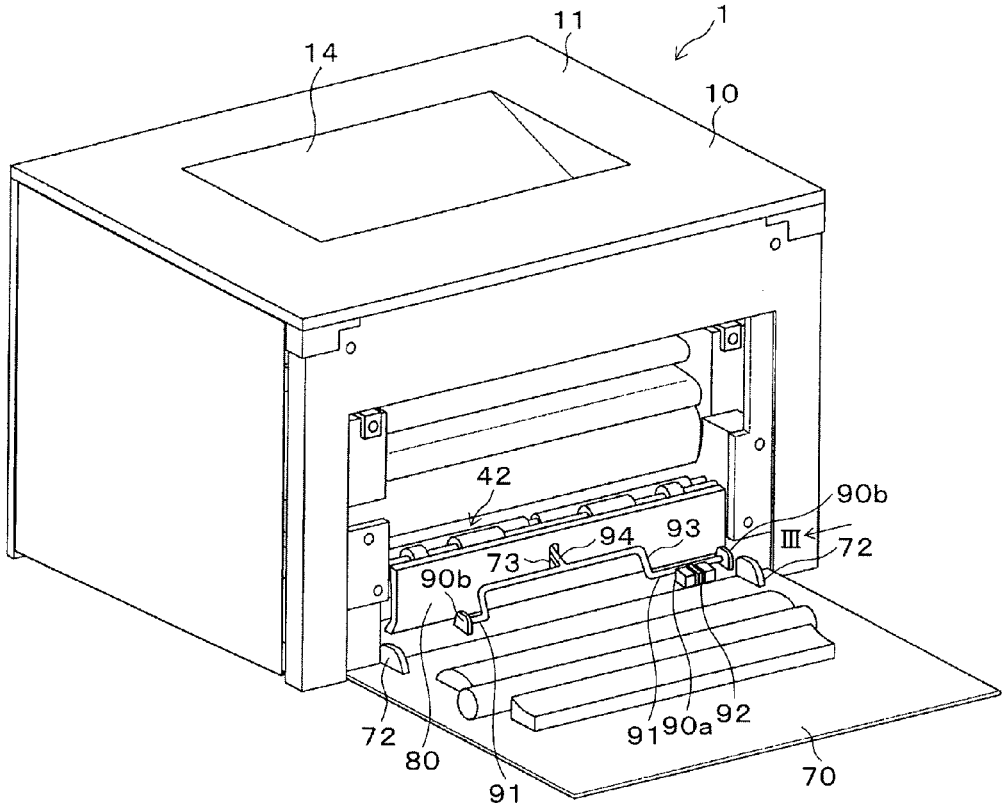
FIG. 2 is a perspective view of the printer of the exemplary embodiment with a front cover opened.
Figure 3:
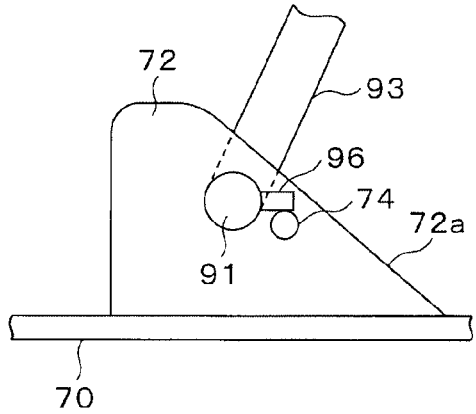
FIG. 3 is a side view illustrating a supporting mechanism of a detection lever of the exemplary embodiment taken from a direction of an arrow III of FIG. 2.

Next, the paper conveying device (sheet conveying device) of this exemplary embodiment will be described with reference to FIGS. 2 through 8. As illustrated in FIG. 2, the front cover 70 is rotatably supported by a hinge 71 on the apparatus main body 10 at a lower edge portion thereof. On right and left sides in the lower edge portion of the front cover 70, supporting pieces 72 are provided. As illustrated in FIG. 3, each supporting piece 72 has an inclined face 72*a* inclined downward from a top portion, and a part where the top portion and the inclined face 72*a* cross each other is in the shape of an arc.

Figure 4:
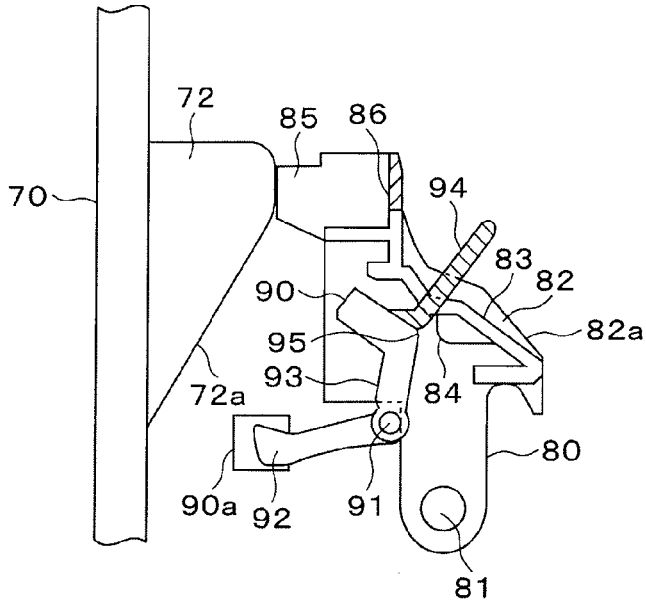
FIG. 4 is a side cross-sectional view of a sheet conveying device according to the exemplary embodiment.

In FIG. 4, a reference numeral 80 denotes a paper guide (sheet guide). The paper guide 80 is provided between the paper separating roller 41*b* and the resist roller pair 42 and corresponds to a part of the paper conveyance path for guiding the paper P to the resist roller pair 42. The paper guide 80 is rotatably supported by a rotation shaft 81 provided on the apparatus main body 10.

The paper guide 80 includes plural of guide portions 82 arranged along the direction of the shaft (that is, a direction perpendicular to the sheet surface of FIG. 4). Each guide portion 82 is in the shape of a plate, one side of which works as a guide face 82*a* to be brought into contact with the paper P. Between two of the guide portions 82 adjacent to each other at substantially the center along the direction of the shaft, a beam 83 extending along the guide face 82*a* is provided. The beam 83 has, on its upper end portion, a stopper (restricting portion) 86 to be brought into contact with a tip of an actuator (sheet detecting section) 90 described later. Furthermore, a moving portion 84 for pushing and rotating the actuator 90 is formed on a lower face of the beam 83, and a part of the moving portion 84 for pushing the actuator 90 has a curved face.

Two of the guide portions 82 disposed at both ends along the direction of the shaft are provided respectively with projecting pieces 85 to be brought into contact with the corresponding supporting pieces 72 when the front cover 70 is closed. The paper guide 80 having the aforementioned structure works together with the actuator 90 described next, so as to detect the paper P and make the actuator 90 recede at time of a jam.

As illustrated in FIG. 4, the actuator 90 is rotatably supported by a rotation shaft 91 provided on the apparatus main body 10. The actuator 90 includes a sensor section 92 extending from the rotation shaft 91 toward the front cover 70. On the other hand, the apparatus main body 10 is provided with a photo-interrupter (detecting means) 90*a*, so as to detect a state where the sensor section 92 blocks the optical axis of the photo-interrupter 90*a* or a state where it is out of the optical axis.

At the both ends of the rotation shaft 91, connecting portions 93 extending upward and then bent laterally to be connected to each other are formed. At the center of the connection portions 93, an arm (projecting portion) 94 extending diagonally upward and backward is formed. As illustrated in FIG. 2, the paper guide 80 is provided with a hole 73 for allowing the arm 94 to pass therethrough. A part of the connecting portion 93 extending upward is provided with a catch 95. The catch 95 is a portion with which the moving portion 84 is brought into contact and has a corner with a curved face.

The actuator 90 having the aforementioned structure is supplied with force for causing clockwise rotation in FIG. 4 by an elastic member not shown. On the other hand, as illustrated in FIG. 3, a pin (restricting portion) 96 is fixed on the rotation shaft 91 and a stopper (restricting portion) 74 to be brought into contact with the pin 96 is fixed on the supporting piece 72. Thus, the rotation of the actuator 90 is restricted, and in this state, the sensor section 92 is in a stand-by position for blocking the optical axis of the photo-interrupter 90*a*.

(3) Function of Paper Conveying Device

Figure 5:
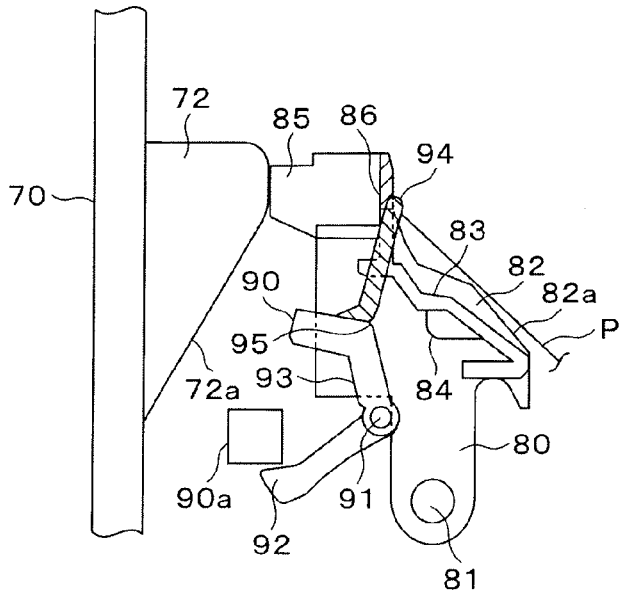
FIG. 5 is a side cross-sectional view of the sheet conveying device shifted from a state illustrated in FIG. 4 to a state where paper comes into contact with the detection lever.

Next, the function of the paper conveying device having the aforementioned structure will be described. As illustrated in FIG. 4, the arm 94 of the actuator 90 protrudes beyond the guide face 82*a* of the paper guide 80 so as to block the paper conveyance path. This state corresponds to the stand-by position where the pin 96 is in contact with the stopper 74. When the paper P is conveyed from the paper drawing section 41, the tip of the paper P comes into contact with the arm 94, so as to rotate the actuator 90 (as illustrated in FIG. 5). Then, the arm 94 comes into contact with the stopper 86 of the paper guide 80 to be stopped, and the paper P is fed beyond the tip of the arm 94. At this point, the sensor section 92 of the actuator 90 is out of the optical axis of the photo-interrupter 90*a*, and hence, the passage of the paper P is discriminated in accordance with a signal transmitted from the photo-interrupter 90*a*.

Figure 6:
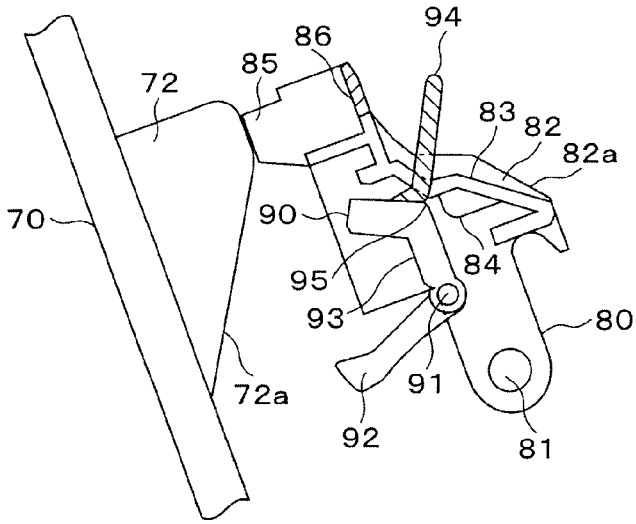
FIG. 6 is a side cross-sectional view of the sheet conveying device shifted from the state illustrated in FIG. 4 to a state where a sheet guide is rotated.
Figure 7:
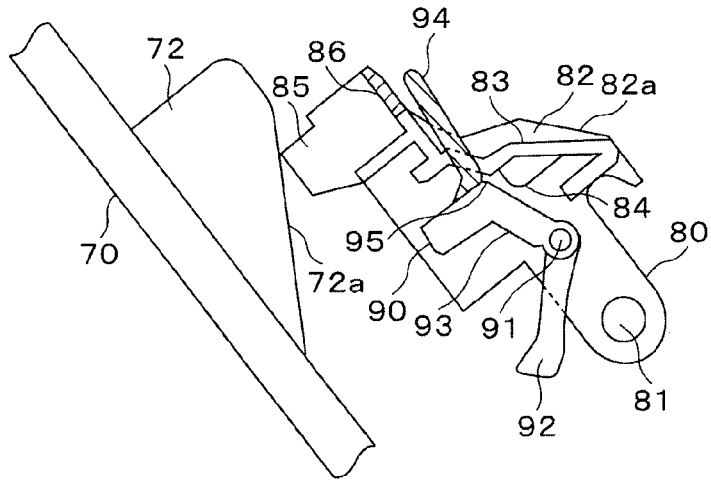
FIG. 7 is a side cross-sectional view of the sheet conveying device shifted from the state illustrated in FIG. 6 to a state where the sheet guide is further rotated.
Figure 8:
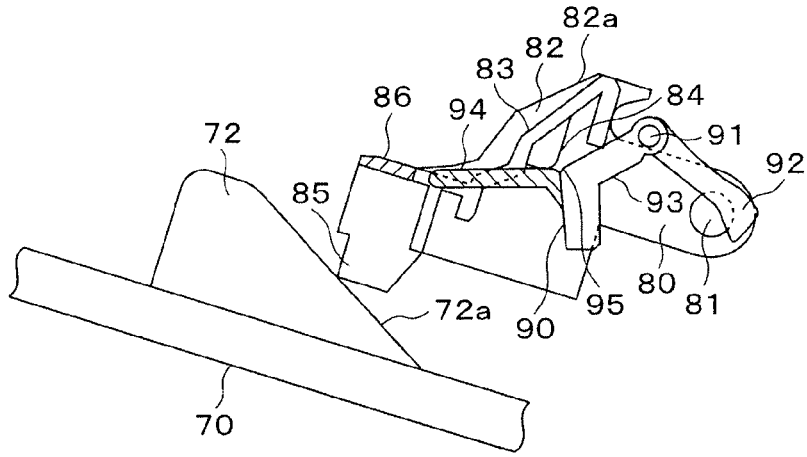
FIG. 8 is a side cross-sectional view of the sheet conveying device shifted from the state illustrated in FIG. 7 to a state where the sheet guide is further rotated.

Next, an operation performed at time of a paper jam will be described. When the front cover 70 is opened, the paper guide 80 inclines together with the front cover 70 due to its own weight (as illustrated in FIG. 6). At this point, the actuator 90 is supplied with the force for causing the clockwise rotation and hence keeps its position. Then, when the moving portion 84 of the paper guide 80 comes into contact with the catch 95 of the actuator 90, the actuator 90 is rotated in the counter-clockwise direction (as illustrated in FIG. 7). At this point, the projecting pieces 85 of the paper guide slide and move on the inclined faces 72*a* of the supporting pieces 72 of the front cover 70.

When the front cover 70 is further rotated, a positional shift between the stopper 86 of the paper guide 80 and the arm 94 of the actuator 90 is increased, and hence the arm 94 slips off from the stopper 86 so as to be hidden in the beam 83 of the paper guide 80. Then, jammed paper P is taken out of the paper conveyance path.

In the paper conveying device having the aforementioned structure, when jammed paper is removed from the paper conveyance path, since the arm 94 is hidden in the beam 83 of the paper guide 80, the arm 94 may be prevented from being damaged by the paper P.

In particular, in the aforementioned exemplary embodiment, since the moving portion 84 of the paper guide 80 comes into contact with the catch 95 of the actuator 90, damage and abrasion of the arm 94 may be suppressed. Furthermore, in the aforementioned exemplary embodiment, since the actuator 90 is supplied with the rotating force and the rotation is restricted to keep the stand-by position by the pin 96 and the stopper 74, the actuator 90 may be kept in the stand-by position regardless of the position of the paper guide 80, and hence, the detection accuracy is improved.

In the aforementioned exemplary embodiment, when the paper guide 80 is rotated by a large angle, the arm 94 slips off from the stopper 86 so as to be hidden in the beam 83 of the paper guide 80, and therefore, the arm 94 never comes into contact with the paper P or a human finger. Accordingly, damage of the arm 94 may be effectively prevented.

In the aforementioned exemplary embodiment, since the moving portion 84 has the curved face in its part in contact with the catch 95 of the actuator 90, damage and abrasion of the catch 95 may be suppressed even when the paper guide 80 is repeatedly rotated. Furthermore, since the paper guide 80 inclines due to its own weight when the front cover 70 is opened, the arm 94 may be made to recede from the paper conveyance path without performing an additional operation.

It is noted that the present invention is not limited to the aforementioned exemplary embodiment but may variously applied. Specifically, the present invention is applicable to any conveying device as far as it conveys something in the shape of a sheet and is applicable to, for example, a paper conveying device for conveying paper after forming an image thereon or a conveying device for conveying paper currencies. Moreover, it is applicable not only to an electrophotographic image forming apparatus but also to an image forming apparatus employing another image forming method such as an ink jet method.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A sheet conveying device with a sheet conveyance path through which a sheet is conveyed, comprising:

a sheet guide that has a first end rotatably supported to move a second end to be close to or away from the sheet conveyance path; and a sheet detecting section that has a first end passing through a hole in the sheet guide and a second end rotatably supported so that the first end is pushed by the sheet and rotated, wherein a rotation shaft of the sheet detecting section is disposed farther from the sheet conveyance path than a rotation shaft of the sheet guide, and the sheet guide is provided with a moving portion for moving the first end of the sheet detecting section to an inside of a guide face of the sheet guide when the first end of the sheet guide is rotated in a direction away from the sheet conveyance path, wherein the sheet detecting section includes a connecting portion extending from the rotation shaft, a projecting portion extending from the connecting portion and passing through a hole in the sheet guide, and a sensor section extending from the rotation shaft, and the moving portion is brought into contact with the connecting portion.

2. The sheet conveying device according to claim 1, wherein a main body of the sheet conveying device includes:

a detecting unit that detects a positional shift of a sensor section;

a force applying unit that applies, to the sheet detecting section, force in a direction toward which a tip of the sheet detecting section passes through a hole in the sheet guide; and a holding unit that restricts movement of the sheet detecting section caused by the force applying unit for holding the sensor section in a precedently determined stand-by position against the detecting unit.

3. The sheet conveying device according to claim 2, wherein the holding unit comprises a pin and a stopper.

4. The sheet conveying device according to claim 2, wherein the holding unit comprises only a stopper.

5. The sheet conveying device according to claim 1, wherein the sheet guide is provided with a restricting portion for restricting rotation caused when the sheet detecting section is pushed by the sheet, and the restricting portion moves away from the first end of the sheet detecting section when the first end of the sheet detecting section is moved to the inside of the guide face of the sheet guide by the moving portion.

6. The sheet conveying device according to claim 5, wherein the restricting portion comprises a pin and a stopper.

7. The sheet conveying device according to claim 5, wherein the restricting portion comprises only a stopper.

8. The sheet conveying device according to claim 1, wherein the moving portion has a curved face in a part brought into contact with the sheet detecting section.

9. The sheet conveying device according to claim 1, further comprising:

a cover that has one edge portion rotatably supported on a main body of the sheet conveying device, wherein the sheet guide is provided inside the cover and is supplied with force for causing rotation toward the cover, and the sheet guide is rotated in connection with opening of the cover.

10. An image forming apparatus comprising a sheet conveying section for conveying a sheet on which an image is formed, wherein the sheet conveying section includes a sheet conveying device of claim 1.

* * * * *